United States Patent [19]

Welch

[11] Patent Number: 4,962,813

[45] Date of Patent: Oct. 16, 1990

[54] WELL TOOL LOCKING SYSTEM FOR STAGGERED BORE

[75] Inventor: William R. Welch, Carrollton, Tex.

[73] Assignee: Otis Engineering Corporation, Dallas, Tex.

[21] Appl. No.: 316,670

[22] Filed: Feb. 28, 1989

[51] Int. Cl.[5] ..... E21B 23/00

[52] U.S. Cl. ..... 166/217

[58] Field of Search ..... 166/382, 212, 215, 216, 166/217

[56] References Cited

U.S. PATENT DOCUMENTS

| | | | |
|---|---|---|---|
| 3,789,925 | 2/1974 | Brown | 166/217 X |
| 4,018,275 | 4/1977 | Gaut | 166/217 X |
| 4,479,539 | 10/1984 | Tamplen et al. | 166/212 |
| 4,545,434 | 10/1985 | Higgins | 166/217 |
| 4,745,974 | 5/1988 | Higgins | 166/217 |
| 4,823,872 | 4/1989 | Hopmann | 166/217 |

OTHER PUBLICATIONS

*Otis SafetySet Lock Mandrel System,* published Jan. 5, 1987.

*Primary Examiner*—William P. Neuder

*Attorney, Agent, or Firm*—Ross, Howison, Clapp & Korn

[57] ABSTRACT

A well tool locking system adapted for releasably locking a lock mandrel and surface-controlled subsurface safety valve in a staggered well bore is disclosed. The subject locking system comprises a collapsible, slidably engaged no-go ring and locating dogs that are operatively coupled to a locking sleeve to pre-prop locking keys in the annular recesses of a landing nipple prior to applying control line pressure to the safety valve. The subject locking system is designed to lock in the direction of flow, does not require the use of shear pins, and will not release from the running tool until the safety valve is activated and the lock mandrel locking keys are fully engaged with the landing nipple.

13 Claims, 7 Drawing Sheets

WELL TOOL LOCKING SYSTEM FOR STAGGERED BORE

TECHNICAL FIELD OF THE INVENTION

This invention relates to well tools, and more particularly, to a locking system suitable for use with a wireline tool string. The locking system of the invention is particularly useful for releasably locking a well tool such as a surface-controlled subsurface safety valve (SCSSV) in a staggered well-bore.

BACKGROUND ART

Lock mandrels useful for releasably locking other well tools such as a wireline-retrievable SCSSV inside a flow conductor are well known. Such lock mandrels have previously been disclosed, for example, in U.S. Pat. Nos. 4,545,434 and 4,745,974. These patents teach the use of a running tool in a wireline tool string for driving a lock mandrel having a SCSSV connected to it into a landing nipple disposed in the flow conductor of a well. The safety valve and lock mandrel are driven downwardly into the landing nipple until a fixed no-go ring on the outer surface of the lock mandrel contacts an opposing no-go shoulder in the landing nipple. The running tool is not releasable from the lock mandrel until the SCSSV has been pressured open, permitting the running tool core to drop, and until the locking keys have engaged in the locking annulus of the landing nipple. The locking keys in the lock mandrel are engaged by jarring upwardly on the running tool.

Although the locking systems disclosed in U.S. Pat. Nos. 4,545,434 and 4,745,974 possess significant advantages when compared to the conventional locking systems previously known, problems have been encountered in using those locking systems when the wellbore is staggered or graduated between the landing nipple and that section of the bore in which the SCSSV is set. In such situations, the control line pressure exerted to pump the safety valve open during the locking process instead forces the lock mandrel and valve assembly upward before the lock mandrel locking keys can be set due to the area differential in the two sections of the staggered bore.

To avoid the foregoing problem, specially modified running tools, safety valves and landing nipples have been required to utilize the locking systems disclosed in U.S. Pat. Nos. 4,545,434 and 4,745,974 in staggered well-bores. These modifications permit the running tool to temporarily lock the lock mandrel in the landing nipple while the safety valve is being pressured open prior to completion of the locking procedure and removal of the running tool.

A releasable well tool locking system is therefore needed that can be used in a flow conductor having a staggered internal bore without the need for a specially modified running tool, safety valve or landing nipple. Such a locking system will preferably comprise a lock mandrel adapted to pre-prop the lock mandrel locking keys in the annular receptacle of the landing nipple to prevent the lock mandrel from being forced upward and out of alignment with the annular receptacle of the landing nipple while the safety valve is being pressured open. A preferred well tool locking system for use in staggered bores will desirably achieve the foregoing objectives in a structure that is adapted to be locked by a sleeve moving in the flow direction; that will not release the running tool unless the safety valve is functional and securely locked by the lock mandrel in the landing nipple; and that does not require the use of shear pins to release and remove the lock mandrel and safety valve from the well-bore.

SUMMARY OF THE INVENTION

The well tool locking system disclosed herein comprises a collapsible, moving no-go that facilitates setting and releasably locking a lock mandrel in a well having a staggered internal bore.

According to a preferred embodiment of the invention, the subject locking system comprises a lock mandrel further comprising a collapsible, slidable no-go that cooperates with the locking sleeve to pre-prop the lock mandrel keys when the lock mandrel and a well tool such as a SCSSV are driven into engagement with a conventional landing nipple. The collapsible, slidably engaged no-go of the invention preferably comprises a snap ring adapted to selectively engage and conform to adjacent graduated-diameter sections of the lock mandrel locking sleeve. The subject no-go preferably further comprises diametrically opposed locating dogs adapted to project outwardly through windows in the locking key retainer sleeve prior to locking for contacting a cooperating no-go shoulder in the landing nipple. After locking, the subject no-go ring is collapsed, drawing the locating dogs radially inward and out of contact with the landing nipple.

According to another embodiment of the invention, a well tool locking system is provided that comprises a lock mandrel adapted to releasably lock a well tool such as a SCSSV in a staggered bore through the use of a locking sleeve that actuates the lock mandrel locking keys while moving in the flow direction.

According to another embodiment of the invention, a well tool locking system is provided that comprises a lock mandrel adapted to be released from the running tool used to install the lock mandrel and a well tool such as a SCSSV in a staggered well bore only after the SCSSV has been operatively coupled to the control line hydraulic system and after the lock mandrel locking keys have fully engaged the locking annulus of the landing nipple.

BRIEF DESCRIPTION OF DRAWINGS

The well tool locking system of the invention is further described, and explained in relation to the accompanying d wherein.

Like numerals are used to indicate like parts in all figures of the drawings.

DETAILED DESCRIPTION OF THE PREFERRED EMBODIMENT

Figure 1:
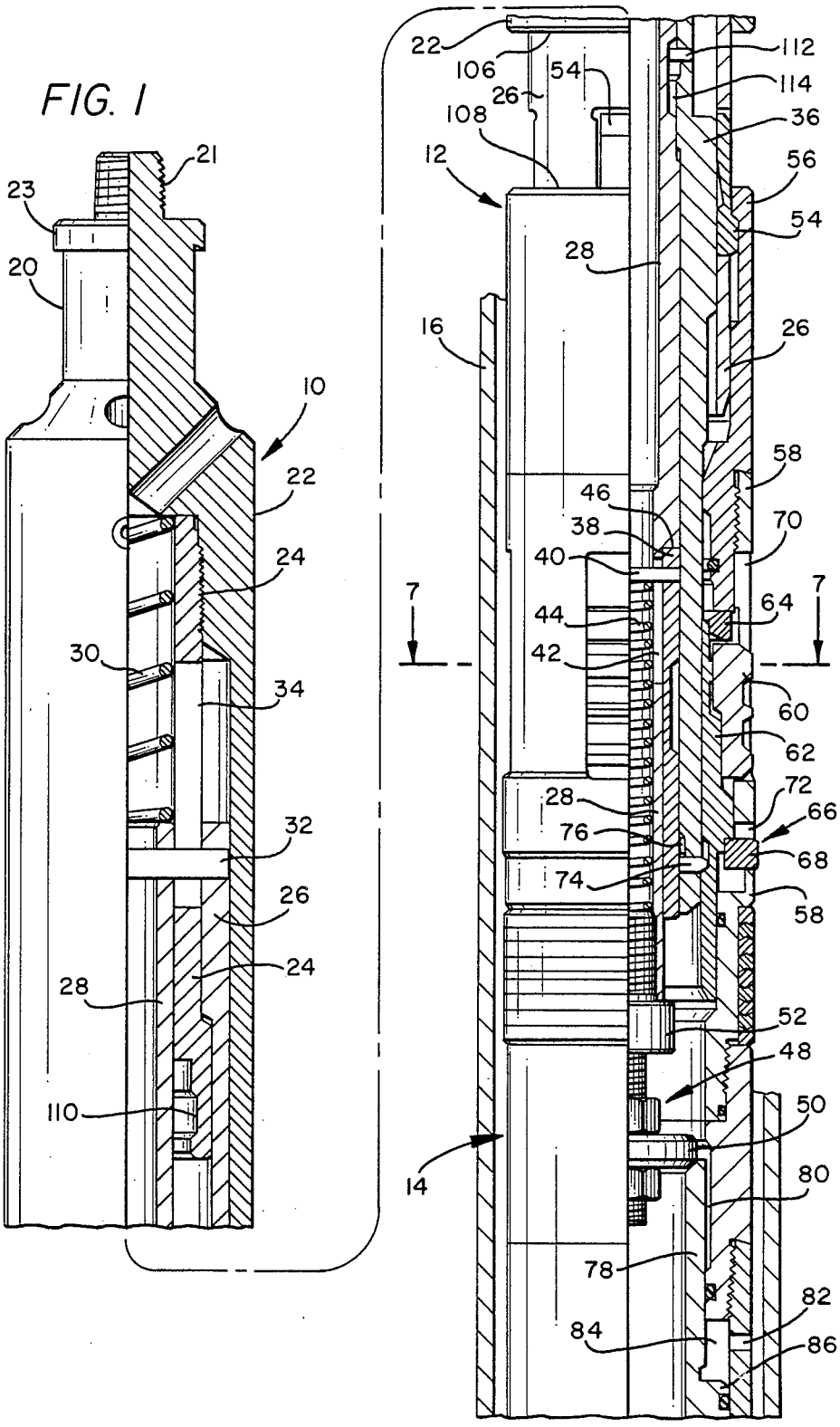
FIG. 1 is an elevation view, partially in section, depicting the well tool locking system of the invention as assembled when being run into a well bore on a wireline.

Referring to FIG. 1, running tool 10, lock mandrel 12 and safety valve 14 are shown as they are operatively coupled when being run into well bore 16 as part of a wireline tool string. Running tool 10 used for installing lock mandrel 12 has a fishing neck 20 provided with standard wireline features for connection in a wireline tool string, not shown. Neck 20 includes a reduced diameter threaded upper end portion 21 and an external annular flange 23. Running tool 10 further comprises running tool top sub 22, threadedly engaged upper setting sleeve 24, retainer sleeve 26, core 28 and coil spring 30. Retainer sleeve 26 and core 28 are maintained in fixed longitudinal alignment by pin 32 extending through window 34 in upper setting sleeve 24. Running tool 10 further comprises lower setting sleeve 36 and insertion sleeve 38. Insertion sleeve 38 is held on core 28 by pin 40 extending through slot 42. Spring 44 cooperates with pin 40 to bias insertion sleeve 38 upwardly against shoulder 46 of core 28. The downwardly extending end portion of running tool 10 comprises core adapter nut 52 and adjustable core extension assembly 48 further comprising annular stop plate 50. Radially expandable retainer dogs 54 releasably couple running tool 10 to fishneck 108 on head 56 of lock mandrel 12 during installation of lock mandrel 12 and safety valve 14 in well bore 16.

Figure 7:
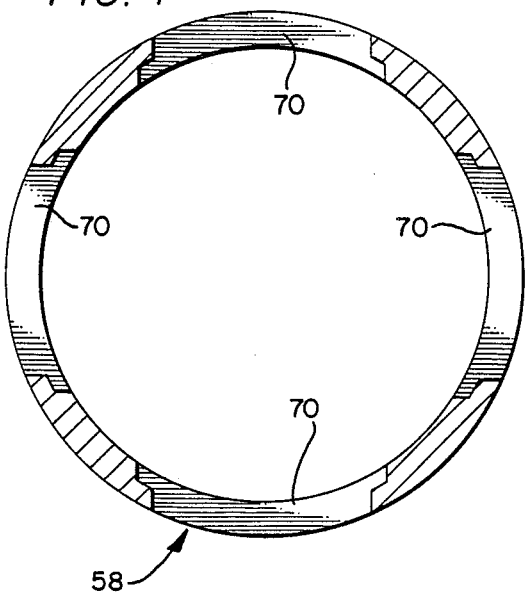
FIG. 7 is a sectional plan view of the lock mandrel body taken along line 7—7 of FIG. 1, depicting in simplified form the circumferential spacing of the windows through which the locking keys engage the landing nipple.
Figure 8:
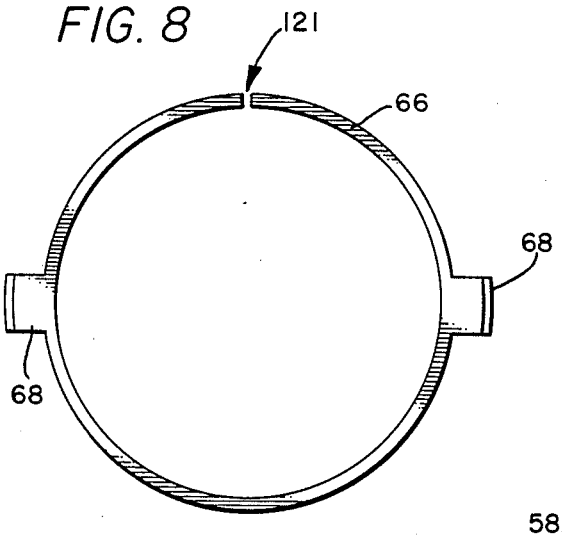
FIG. 8 is a plan view of the collapsible, sliding no-go of the invention.
Figure 9:
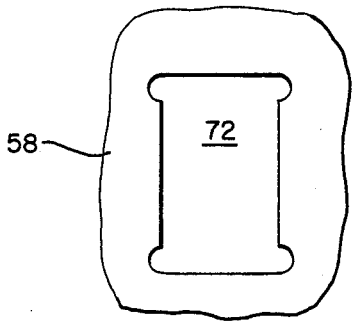
FIG. 9 is a simplified front elevation view of a window in the lock mandrel body through which the locating dog of the no-go ring engages the no-go shoulder of the landing nipple.

Referring to FIGS. 1 and 8, lock mandrel 12 preferably further comprises locking key retainer sleeve 58, locking keys 60, locking sleeve 62, locking sleeve retainer ring 64 and collapsible no-go ring 66 further comprising no-go locating dogs 68. Referring to FIGS. 1 and 7, locking keys 60 are fully retracted within windows 70 of locking key retainer sleeve 58 to avoid impeding the insertion of lock mandrel 12 into well bore 16. Windows 72 in locking key retainer sleeve 58, shown in greater detail in FIG. 9, are provided to permit no-go locating dogs 68 to extend therethrough during landing and locking of lock mandrel 12 in landing nipple 18. During insertion of running tool 10, lock mandrel 12 and safety valve 14 into well bore 16, locking sleeve 62 is maintained in the position shown in FIG. 1 by an interference fit with locking sleeve retainer ring 64, which is a snap ring, and by locking lugs 74 which extend into annular recess 76 on the inwardly facing surface of locking sleeve 62.

Safety valve 14 preferably further comprises piston 78 slidably disposed in bore 80 and adapted to be actuated by hydraulic pressure applied through port 82 and annulus 84 against annular lug 86.

Figure 2:
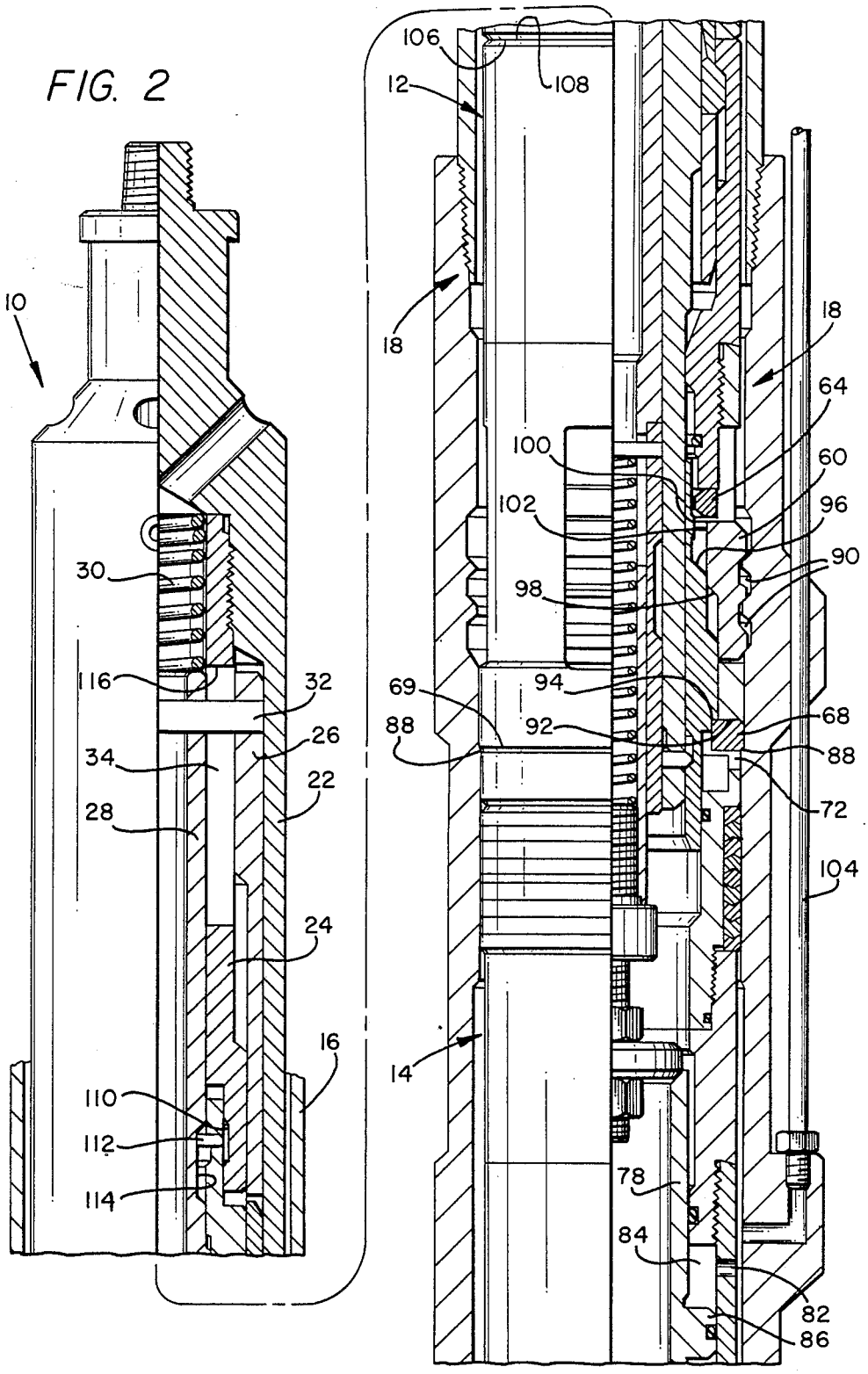
FIG. 2 is an elevation view, partially in section, depicting the well tool locking system of the invention after the lock mandrel has been driven into the landing nipple.

Referring to FIG. 2, lock mandrel 12 and safety valve 14 are driven into landing nipple 18 to the point where no-go locating dogs 68 contact inwardly facing annular no-go shoulder 88. When no-go locating dogs 68 contact annular shoulder 88, no-go locating dogs 68 and no-go ring 66 are caused to slide upwardly until external no-go shoulder 69 on locking key retainer sleeve 58 stops against annular no-go shoulder 88 in landing nipple 18. As no-go locating dogs 68 slide upward, top edge 92 of no-go ring 66, which abuts outwardly facing annular notch 94 of locking sleeve 62, causes locking sleeve 62 to travel upwardly the same distance. As locking sleeve 62 moves upward, beveled shoulder 96 of locking sleeve 62 contacts and slides past cooperating bevelled shoulder 98 of locking keys 60, causing locking keys 60 to be forced radially outward through windows 70 to partially engage cooperating recesses 90 in landing nipple 18.

The use of no-go locating dogs 68 that can slide upwardly in windows 72 upon contact with annular shoulder 88 of landing nipple 18 to cause bevelled shoulder 96 of locking sleeve 62 to pre-prop or partially engage locking keys 60 in annular recesses 90 of landing nipple 18 is a significant feature of the present invention that is not disclosed by the prior art. This pre-prop locking feature prevents lock mandrel 12 and locking keys 60 from being pressured upward out of alignment with annular recesses 90 of locking nipple 18 whenever hydraulic force is applied through control line 104, port 82 and annulus 84 to lug 86 of piston 78 of safety valve 14 in a flow conductor having a staggered internal bore.

Figure 11:
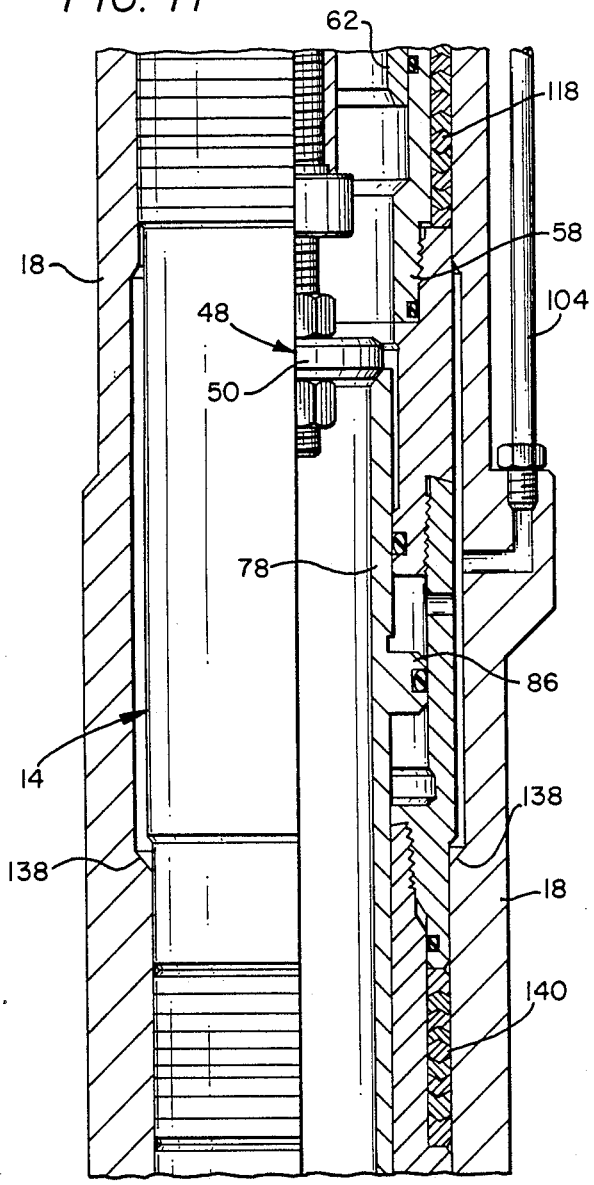
FIG. 11 is an elevation view, partially in section, depicting a subsurface safety valve disposed in a staggered bore.

FIG. 11 discloses a portion of safety valve 14 disposed below locking key retainer sleeve 58 of lock mandrel 12 in which piston 78 is shown in the same position as in FIG. 2, after lock mandrel 12 is landed in landing nipple 18. Shoulder 138 of landing nipple 18 defines the beginning of a downwardly extending, inwardly staggered bore section, as shown adjacent to packing 140, that has a diameter smaller than that of the upwardly extending bore section adjacent packing 118.

As lock mandrel 12 is landed in landing nipple 18, bottom edge 106 of running tool top sub 22 as shown in FIG. 1 slides downward over retainer sleeve 26 into contacting and abutting relation with fishneck 108 of lock mandrel 12. As running tool top sub 22 slides downward over retainer sleeve 26, upper setting sleeve 24 moves downward to a point where internal annular recess 110 of upper setting sleeve 24 is aligned with transfer lug 112 in lower setting sleeve 36 aligned with recess 114 of core 28. Simultaneously, top edge 116 of window 34 moves downward relative to pin 32, thereby compressing coil spring 30.

Figure 3:
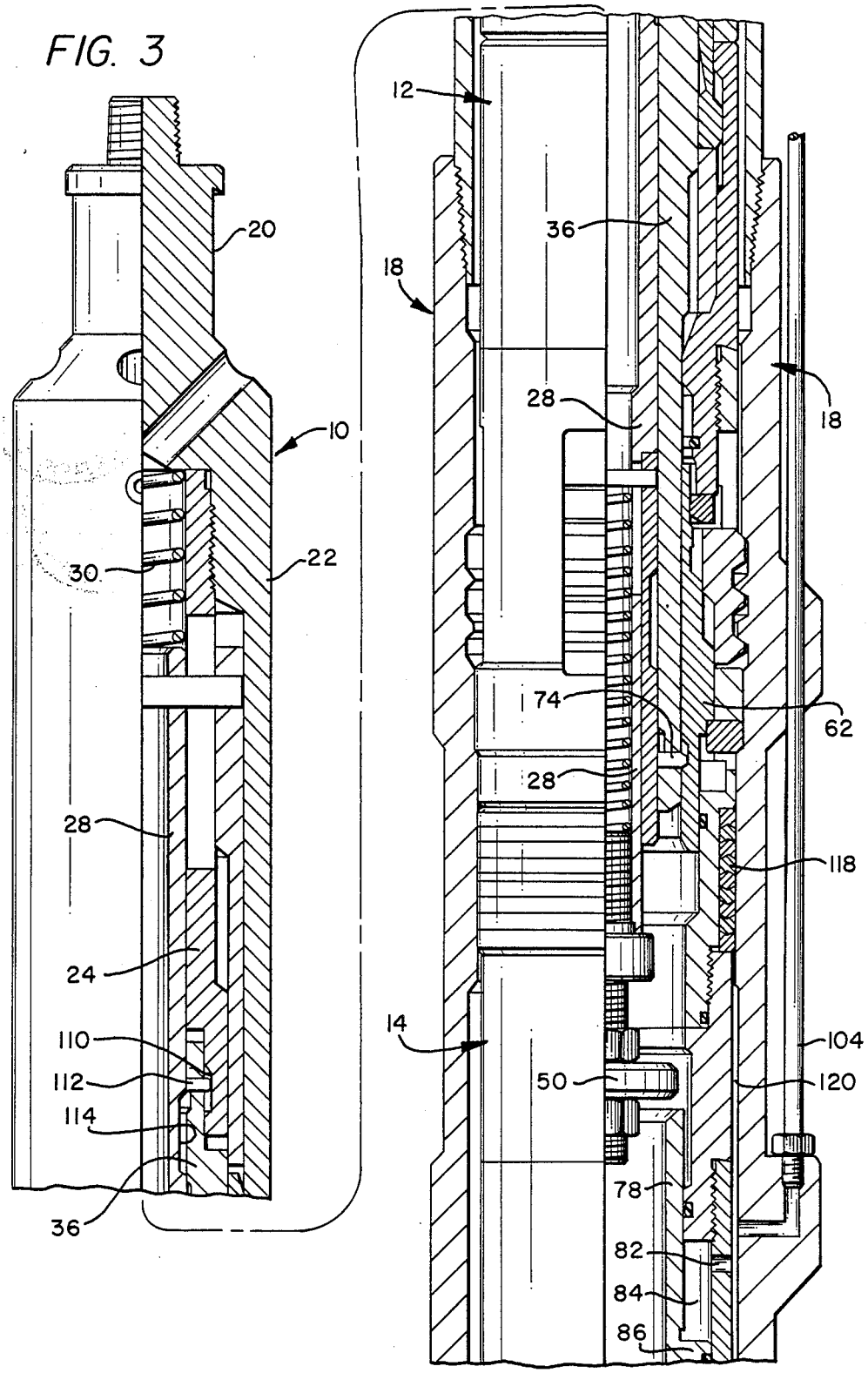
FIG. 3 is an elevation view, partially section, depicting the well tool locking system of the invention after the landed safety valve has been pressured open, permitting the running tool core to drop.

After lock mandrel 12 is landed in landing nipple 18, locking keys 60 are pre-propped in annular recesses 90 of landing nipple 18 and running tool top sub 22 is forced downward over retainer sleeve 26 into contacting and abutting relationship to fishneck 108 of lock mandrel 12. Hydraulic pressure is applied to annular lug 86 of safety valve piston 78 from a surface valve (not shown) through control line 104. Referring to FIGS. 3 and 11, packing 118, 140 between locking key retainer sleeve 58 and the interiorly facing surface of landing nipple 18 confine hydraulic fluid in annulus 120 and directs the fluid through port 82 into annulus 84. As safety valve 14 is pressured open, valve piston 78 is forced downward, permitting core 28 of running tool 10 to drop under gravitational force, partially relaxing coil spring 30. As core 28 drops, recess 114 moves downward past transfer lug 112 camming transfer lug 112 into internal annular recess 110 of upper setting sleeve 24. Because lower setting sleeve 26 is at this point connected to upper setting sleeve 24 by transfer lug 112 and to locking sleeve 62 by locking lug 74, lock mandrel 12 is in a position to be fully locked by jarring upwardly on top sub 22 of running tool 10. Unless locking keys 60 are pre-propped into annular recesses 90 as safety valve 14 is pumped open, the differential pressure caused by the staggered internal bore will force lock mandrel 12 and safety valve 14 upwardly relative to landing nipple 18, simultaneously forcing locking, keys 60 out of alignment with annular recesses 90. Referring to FIG. 3, because locking keys 60 are pre-propped into annular recesses 90 as described above, annular recesses 90 limit locking keys 60 and lock mandrel 12 from further upward motion relative to landing nipple 18 until locking keys 60 are fully locked as described below.

Figure 4:
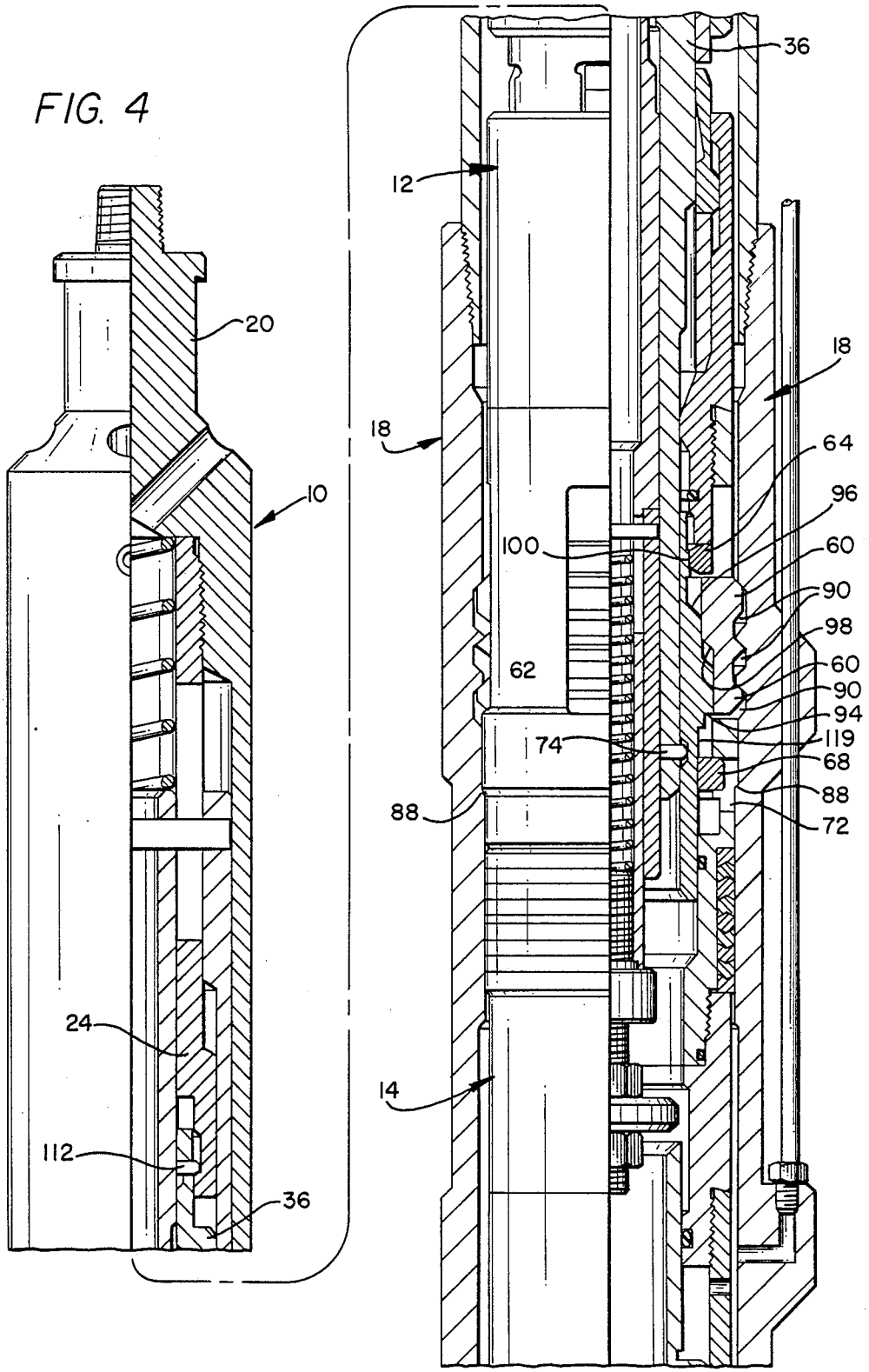
FIG. 4 is an elevation view, partially in section, depicting the well tool locking system of the invention wherein the running tool is jarred upwardly to fully engage the lock mandrel locking keys in the annular recesses of the landing nipple.
Figure 6:
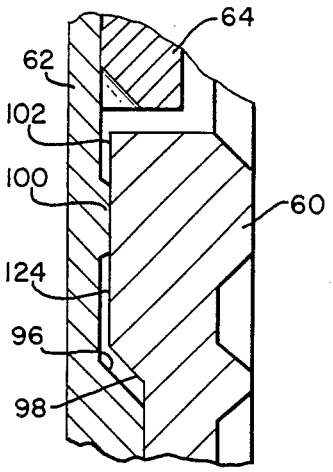
FIG. 6 is a sectional detail view more clearly depicting the cooperative structural relationship between the lock mandrel locking sleeve, the locking sleeve retainer ring and the locking key as shown in FIG. 1.

Referring to FIG. 4, running tool 10 is jarred upwardly by the wireline equipment (not shown) causing upper setting sleeve 24, co-acting with lower setting sleeve 36 through transfer lug 112 and locking lugs 74, to force locking sleeve 62 upward to a position where locking keys 60 are fully engaged in annular recesses 90 of landing nipple 18. As bevelled shoulder 96 moves upward under locking keys 60, locking sleeve retainer ring 64 is cammed radially outward by annular boss 100. Annular boss 100 is more clearly depicted in FIG. 6, although the relative positions of locking sleeve 62, boss 100, locking key retainer sleeve 58 and locking key 60 as shown in FIG. 6 correspond to the relative positions of those elements as shown in FIG. 1, before bevelled shoulder 96 of locking sleeve 62 moves upward past bevelled shoulder 98 and behind the most inwardly extending surface 102 of locking key 60. As locking sleeve 62 fully props keys 60 into annular recesses 90 of landing nipple 18, annular notch 94 in locking sleeve 62 moves upward beyond the range of travel of no-go locating dogs 68 in window 72, causing no-go ring 66 to snap radially inward. This in turn causes no-go locating dogs 68 to be withdrawn from contact with annular no-go shoulder 88 within landing nipple 18. The diameter of no-go ring 66 is desirably sized to conform to the outer diameter of section 119 of locking sleeve 62. Sawcut 121 in no-go ring 66, as shown in FIG. 8, enables the ring to be expanded slightly for installing the ring around annular notch 94 during makeup of lock mandrel 12.

Figure 5:
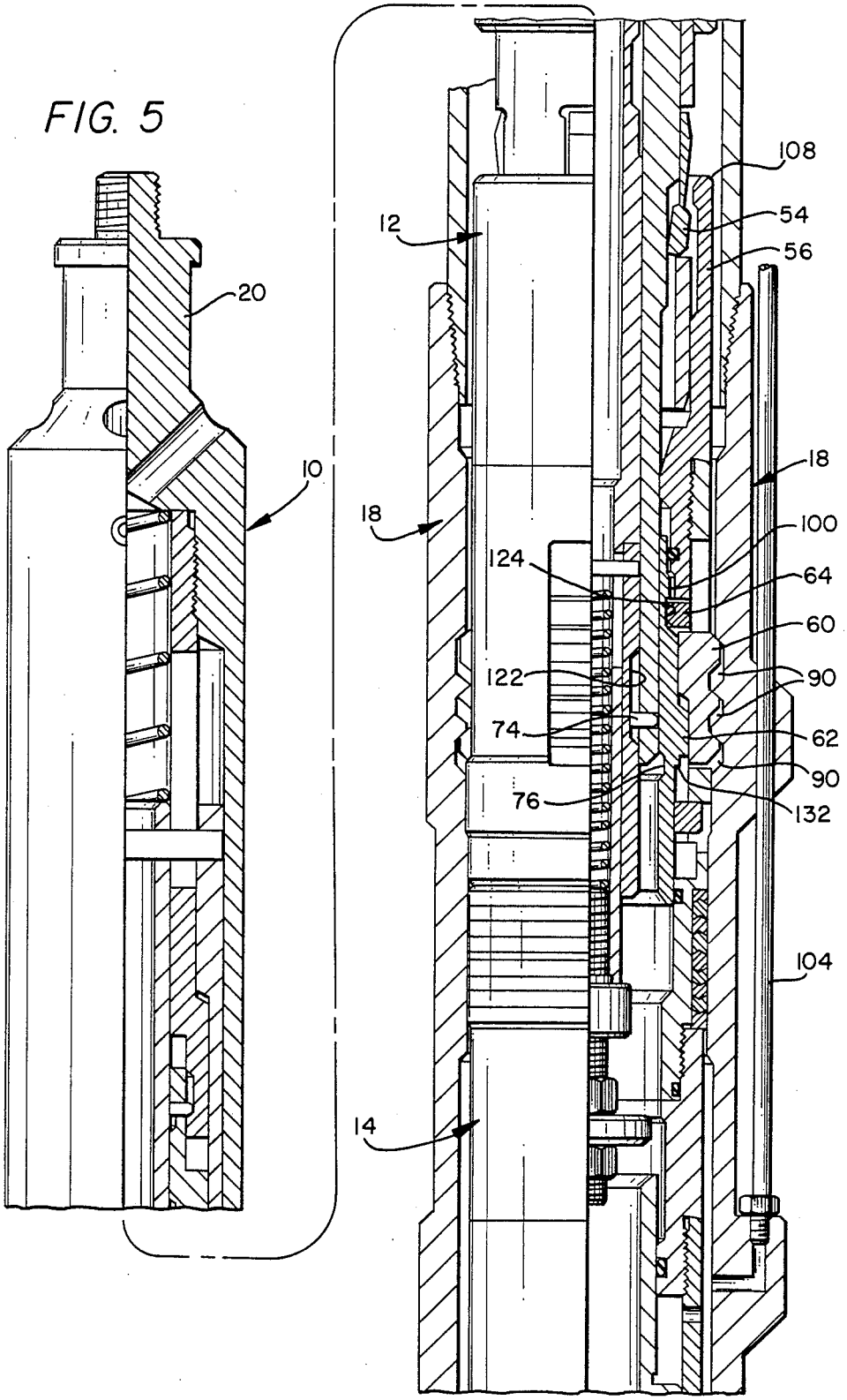
FIG. 5 is an elevation view, partially in section, depicting the well tool locking system of the invention in its fully locked position, wherein the running tool is released from the lock mandrel and ready to be withdrawn from the well bore.

Referring to FIG. 5, once safety valve 14 is activated by pressure exerted through control line 104 and locking sleeve 62 has propped locking keys 60 into their fully engaged positions relative to annular recesses 90 of landing nipple 18, running tool 10 can be released from lock mandrel 12 and removed from the well bore. As lower setting sleeve 36 raises locking sleeve 62 to its uppermost position, locking lug 74 is cammed out of annular recess 76 in locking sleeve 62 and into recess 122 in insertion sleeve 38, thereby releasing lower setting sleeve 36 from direct attachment to lock mandrel 12. As locking sleeve 62 moves to its uppermost position relative to locking sleeve retainer ring 64, boss 100 slips upward past locking sleeve retainer ring 64, permitting it to snap into detent 124 which is more clearly shown in FIG. 6. Once locking sleeve retainer ring 64 has snapped into detent 124, locking sleeve 62 is maintained in its uppermost position so as to keep locking keys 60 propped outwardly into annular recesses 90 of landing nipple 18. Retainer dogs 54 release fishneck 108 in head 56 of lock mandrel 12, and running tool 10 is thereafter withdrawn from lock mandrel 12.

Figure 10:
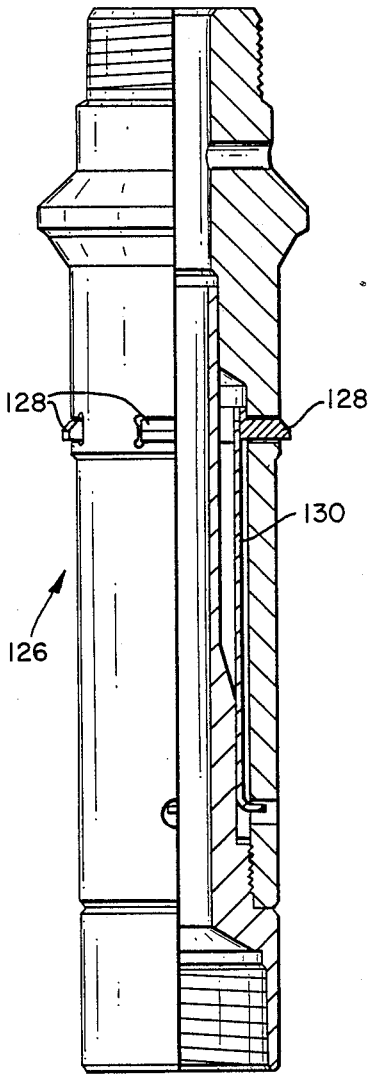
FIG. 10 is an elevation view, partially in section, of an unlocking tool adapted for use in releasing the well tool locking system of the invention from a well bore.

Once it is desired to remove lock mandrel 12 and safety valve 14 from the well bore, a wireline tool string having a conventional pulling tool assembly such as a Type "GR" pulling tool assembly manufactured by Otis Engineering Corporation and having an unlocking tool 126 as shown in FIG. 10 operatively coupled to its distilled end is driven downward through the well bore into engagement with lock mandrel 12. Referring to FIG. 10, dogs 128 on the unlocking tool engage annular recess 76 in locking sleeve 62 before the collet dogs of the pulling tool (not shown) engage fishneck 108 of head 56 of lock mandrel 12. Dogs 128 of unlocking tool 126 are forced radially outward by springs 130 and the spring force exerted on dogs 128 is desirably greater than the force required to move boss 100 of locking sleeve 62 downward past locking sleeve retainer ring 64 so that locking keys 60 can be retracted out of annular recesses 90 in landing nipple 118 into flush alignment with the outside surface of windows 70 in locking key retainer sleeve 58. As locking sleeve 62 is forced downward, collapsed no-go ring 66 is moved sufficiently downward that by advancing shoulder 132 (as shown in FIG. 5), that locking key 60 can be fully disengaged from landing nipple 18 by upward jarring.

Although the locking system of the invention is described herein in relation to its preferred embodiment comprising a lock mandrel and a surface-controlled subsurface safety valve, it will be apparent to those of ordinary skill in the art upon reading this disclosure that the collapsible, slidably engaged no-go ring and locating dogs disclosed herein can be similarly useful when selectively applied to other well tools. Once lock mandrel 12 is disengaged from landing nipple 18, it can be lifted out of the well by the wireline equipment. Other alterations and modifications of the invention will also become apparent to those of ordinary skill in the art upon reading the present disclosure, and it is intended by the inventor that the scope of the invention be limited only by the broadest interpretation of the appended claims to which h is legally entitled.

I claim:

1. A lock mandrel comprising a locking key retainer sleeve; locking keys; a first set of windows in said locking key retainer sleeve; a locking sleeve slidably disposed within said locking key retainer sleeve, said locking sleeve being adapted to force said locking keys through said first set of windows; a longitudinally slidable no-go ring further comprising a split ring member adapted to circumferentially engage said locking sleeve and a plurality of unitary, outwardly extending locating dogs circumferentially spaced around said split ring member; said locking key retainer sleeve further comprising a second set of windows adapted to receive said locating dogs; and said locating dogs being further adapted to extend radially outward through said second set of windows.

2. The lock mandrel of claim 1 wherein said locking sleeve further comprises at least two longitudinally adjacent sections having first and second outer diameters adapted to receive said split ring member of said no-go ring, said first diameter being greater than said second diameter, and said split ring member of said no-go ring being adapted to sequentially engage said first and second diameter sections, and being further adapted to be slidably moved from said first diameter section to said second diameter section.

3. The lock mandrel of claim 2 wherein said locating dogs of said no-go ring extend outwardly through said second set of windows of said locking key retainer sleeve when said split ring member circumferentially engages said first diameter section of said locking sleeve, and are retracted radially inward through said second set of windows when said split ring member circumferentially engages said second diameter section of said locking sleeve.

4. The lock mandrel of claim 3 wherein said second set of locating dogs are longitudinally slidable within said windows when said split ring member circumferentially engages said first diameter section of said locking sleeve.

5. A well tool locking system for releasably locking a safety valve in a well bore, said locking system comprising a lock mandrel and a landing nipple adapted to receive said lock mandrel;

said landing nipple further comprising an annular no-go shoulder adapted to limit downward travel of said lock mandrel in said well bore;

said lock mandrel further comprising a locking key retainer sleeve, a locking sleeve slidably disposed within said locking key retainer sleeve, and a longitudinally slidable no-go ring further comprising a split ring member adapted to circumferentially engage said locking sleeve and a plurality of outwardly extending locating dogs circumferentially spaced around said split ring member, said locking key retainer sleeve further comprising a plurality of windows adapted to receive said locating dogs, and said locating dogs being further adapted to extend radially outward through said windows to contact said annular no-go shoulder of said landing nipple;

said lock mandrel further comprising a plurality of circumferentially spaced locking keys, said landing nipple further comprising recesses adapted to receive said locking keys, and said lock mandrel further comprising means for pre-propping said locking keys into engagement with said recesses when said locating dogs contact said annular no-go shoulder.

6. The well tool locking system of claim 5 wherein said locking sleeve further comprises at least two longitudinally adjacent sections having first and second outer diameters adapted to receive said split ring member of said no-go ring, said first diameter being greater than said second diameter, and said split ring member of said no-go ring being adapted to sequentially engage said first and second diameter sections, and being further adapted to be slidably moved from said first diameter section to said second diameter section.

7. The well tool locking system of claim 6 wherein said locating dogs of said no-go ring extend outwardly through said windows of said locking key retainer sleeve when said split ring member circumferentially engages said first diameter section of said locking sleeve, and are retracted radially inward through said windows when said split ring member circumferentially engages said second diameter section of said locking sleeve.

8. The well tool locking system of claim 7 wherein said locating dogs are longitudinally slidable within said windows when said split ring member circumferentially engages said first diameter section of said locking sleeve.

9. A well tool locking system adapted to releasably lock a safety valve in a staggered well bore, said well tool locking system comprising a lock mandrel and a landing nipple having annular recesses adapted to receive and engage said lock mandrel;

said lock mandrel further comprising a locking key retainer sleeve, a locking sleeve slidably disposed within said locking key retainer sleeve, a plurality of circumferentially spaced locking keys for use in releasably engaging said lock mandrel with said annular recesses of said landing nipple, and means for maintaining alignment between said locking keys and said annular recesses of said landing nipple while pressuring open said safety valve.

10. The well tool locking system of claim 10 wherein said means for maintaining alignment between said locking keys and said annular recesses of said landing nipple while pressuring open said safety valve comprises a longitudinally slidable no-go ring further comprising a split ring member adapted to circumferentially engage said locking sleeve and a plurality of outwardly extending locating dogs circumferentially spaced around said split ring member, said split ring member being adapted to cause said locking sleeve to force said locking keys into partial engagement with said annular recesses; said locking key retainer sleeve further comprising a plurality of windows adapted to receive said locking dogs; and said locking dogs being further adapted to extend radially outward through said windows.

11. The well tool locking system of claim 10 wherein said locking sleeve further comprises at least two longitudinally adjacent sections having first and second outer diameters adapted to receive said split ring member of said no-go ring, said first diameter being greater than said second diameter, and said split ring member of said no-go ring being adapted to sequentially engage said first and second diameter sections, and being further adapted to be slidably moved from said first diameter section to said second diameter section.

12. The well tool locking system of claim 11 wherein said locating dogs of said no-go ring extend outwardly through said windows of said locking key retainer sleeve when said split ring member circumferentially engages said first diameter section of said locking sleeve, and are retracted radially inward through said windows when said split ring member circumferentially engages said second diameter section of said locking sleeve.

13. The well tool locking system of claim 12 wherein said locating dogs are longitudinally slidable within said windows when said split ring member circumferentially engages said first diameter section of said locking sleeve.

* * * * *